US010810805B2

(12) United States Patent
Camacho et al.

(10) Patent No.: US 10,810,805 B2
(45) Date of Patent: Oct. 20, 2020

(54) METHOD FOR CLEANING ENGINE DEPOSITS

(71) Applicant: MOC PRODUCTS COMPANY, INC., Pacoima, CA (US)

(72) Inventors: Michael J. Camacho, Rancho Cucamonga, CA (US); Michael David Klugman, Valencia, CA (US); Daniela Vlahova, Valencia, CA (US); Vic Estrada, Burbank, CA (US); Dean Austin Puett, III, Palmdale, CA (US)

(73) Assignee: MOC Products Company, Inc., Pacoima, CA (US)

( * ) Notice: Subject to any disclaimer, the term of this patent is extended or adjusted under 35 U.S.C. 154(b) by 150 days.

(21) Appl. No.: 15/902,925

(22) Filed: Feb. 22, 2018

(65) Prior Publication Data

US 2018/0247468 A1 Aug. 30, 2018

Related U.S. Application Data

(60) Provisional application No. 62/463,113, filed on Feb. 24, 2017.

(51) Int. Cl.

| | |
|---|---|
| ***G07C 5/00*** | (2006.01) |
| ***F02M 65/00*** | (2006.01) |
| ***F02B 77/04*** | (2006.01) |
| ***G07C 5/08*** | (2006.01) |
| ***B08B 5/04*** | (2006.01) |
| *B08B 9/00* | (2006.01) |

(52) U.S. Cl.
CPC ..... *G07C 5/008* (2013.01); *B08B 5/043* (2013.01); *F02B 77/04* (2013.01); *B08B 9/00* (2013.01); *F02M 65/007* (2013.01); *G07C 5/0808* (2013.01); *G07C 2205/02* (2013.01)

(58) Field of Classification Search
CPC ..... G07C 5/008; G07C 5/0808; B08B 5/043; F02B 77/04; F02M 65/007
USPC ..... 123/198 A
See application file for complete search history.

(56) References Cited

U.S. PATENT DOCUMENTS 5,063,896 A * 11/1991 Hyatt ..... F02B 77/04 123/198 A
5,232,513 A * 8/1993 Suratt ..... F02B 77/04 134/169 A
5,381,810 A * 1/1995 Mosher ..... F02B 77/04 123/198 A (Continued)

*Primary Examiner* — David Hamaoui
*Assistant Examiner* — John D Bailey
(74) *Attorney, Agent, or Firm* — Fulwider Patton LLP; Michael J. Moffatt

(57) ABSTRACT

A method for cleaning a combustion engine using a cleaning apparatus, wherein a cable is coupled to an on-board diagnostic port on the vehicle, and a service hose with a misting nozzle adapter is coupled to a first port on a vehicle. A controller monitors data from the on-board diagnostic port on a vehicle, where the data preferably includes the engine rpm, the catalytic convertor temperature, the engine coolant temperature, the MAF, and the MAP. The controller monitors information from the cleaning apparatus, and the information is processed to adjust the dispensing of the cleaning solution. The adjustment of the cleaning solution can vary the rate, volume, pressure, pulse interval, flow pattern, and duration of the solution in the engine.

10 Claims, 12 Drawing Sheets

(56) References Cited

U.S. PATENT DOCUMENTS 5,826,602 A * 10/1998 Chen ..... F02B 77/04 134/20
6,071,355 A * 6/2000 Suratt ..... F02B 77/04 134/20
6,178,977 B1 * 1/2001 Wells ..... F02B 77/04 134/102.1
6,584,993 B1 * 7/2003 Chang ..... F02B 77/04 123/198 A
6,715,502 B1 * 4/2004 Rome ..... F02B 77/04 134/111
2003/0015554 A1 * 1/2003 Gatzke ..... F02B 77/04 222/181.2
2005/0258266 A1 * 11/2005 Elia ..... F02M 61/1853 239/5
2006/0201472 A1 * 9/2006 Kerns ..... F02B 77/04 123/198 A
2006/0219269 A1 * 10/2006 Rice ..... F01D 25/002 134/34
2008/0010774 A1 * 1/2008 Erwin ..... B08B 9/045 15/304
2008/0149141 A1 * 6/2008 Sales ..... B08B 3/026 134/22.1
2008/0271437 A1 * 11/2008 Matsunaga ..... F01N 13/009 60/285
2008/0283098 A1 * 11/2008 Ogasawara ..... F02M 25/00 134/22.1
2008/0283100 A1 * 11/2008 Ogasawara ..... B08B 9/00 134/111
2010/0115721 A1 * 5/2010 Gugaratshan ..... F02B 77/04 15/104.011
2013/0133633 A1 * 5/2013 Yamana ..... F02M 26/33 123/568.12
2014/0060015 A1 * 3/2014 Yan ..... F01N 3/208 60/286
2015/0107625 A1 * 4/2015 Erwin ..... F02B 77/04 134/18
2015/0108252 A1 * 4/2015 Ogawa ..... C11D 7/24 239/306
2016/0102606 A1 * 4/2016 Thompson ..... F02M 35/10 134/23
2016/0215690 A1 * 7/2016 Thompson ..... F02B 77/04
2016/0230592 A1 * 8/2016 Saenz ..... B01F 13/0035
2016/0252025 A1 * 9/2016 Martin ..... F02D 41/0002 701/102
2016/0305318 A1 * 10/2016 Liu ..... F02B 77/04
2017/0159621 A1 * 6/2017 Irwin ..... F02M 35/08
2017/0241335 A1 * 8/2017 Liu ..... F02M 65/007
2017/0248075 A1 * 8/2017 Nemeth ..... B65D 83/14
2018/0238229 A1 * 8/2018 Thompson ..... C10L 1/1905
2018/0238230 A1 * 8/2018 Thompson ..... F02M 35/10209
2019/0162096 A1 * 5/2019 Hoehne ..... F01N 3/2066

* cited by examiner

FIG. 2
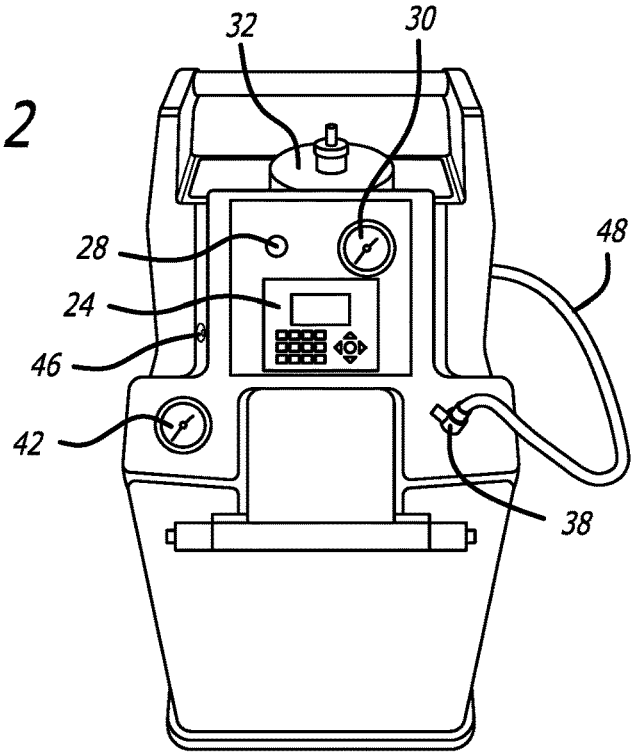
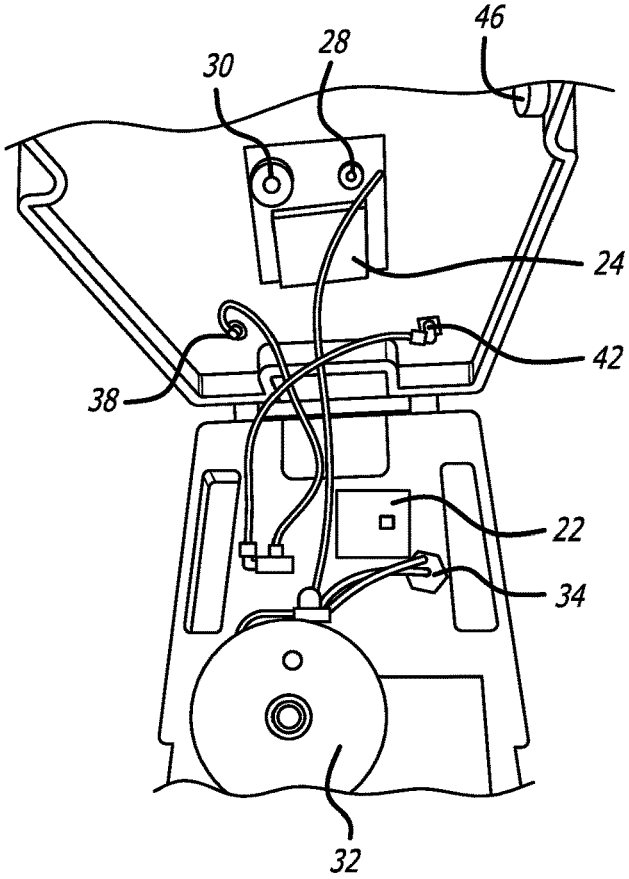
FIG. 3

| INDUCTION SERVICE TABLE | | | |
|---|---|---|---|
| | ON TIME | OFF TIME | RATIO |
| | T1 (sec) | T2 (sec) | |
| 1 | 5 | 20 | 1:4 |
| 2 | 5 | 15 | 1:3 |
| 3 | 10 | 10 | 1:1 |
| 4 | 15 | 10 | 3:2 |
| 5 | 25 | 10 | 5:2 |
| 6 | ON | 0 | 1:0 |
| TABLE 1 | | | |

FIG. 9

| EGR SERVICE TABLE | | | |
|---|---|---|---|
| | ON TIME | OFF TIME | RATIO |
| | T1 (sec) | T2 (sec) | |
| 1 | 4 | 15 | 4:15 |
| 2 | 7 | 20 | 7:20 |
| 3 | 7 | 15 | 7:15 |
| 4 | 10 | 15 | 2:3 |
| 5 | 10 | 10 | 1:1 |
| 6 | ON | 0 | 1:0 |
| TABLE 2 | | | |

FIG. 10

METHOD FOR CLEANING ENGINE DEPOSITS

CROSS-REFERENCES TO RELATED APPLICATIONS

This application claims priority from U.S. Application No. 62/463,113, filed Feb. 24, 2017, incorporated by reference in its entirety.

BACKGROUND

Some vehicles in the industry have port fuel injection ignition engine systems, direct injection ignition engine systems or diesel engine systems. It is well known in the art that deposits form on the surface of engine components, such as carburetor ports, throttle bodies, fuel injectors, intake ports and intake valves. These deposits often cause noticeable drive ability issues and may negatively impact the air/fuel ratio, the combustion, or the ignition performance. Moreover, engine deposits can significantly increase the fuel consumption and production of exhaust pollutants.

Current methods of removing deposits include gasoline additives, manual cleaning and detergent cleaning solutions. Since gasoline does not come in contact with the intake valves of a direct injection ignition engine system, gasoline additives are not an effective solution for that type of system. The method of manual cleaning involves invasive dismantling of the engine in order to clean the components which is labor-intensive and time consuming.

Traditional intake cleaning methods use detergent cleaning solutions and are typically performed by professional technicians by dispensing cleaning solutions into the intake system at a vacuum source near the throttle body or through the throttle body itself. This enables the low pressure inside of the intake manifold to allow the cleaning solution to flow to the valve areas in the hope that enough fluid or mist reaches the area to achieve effective cleaning of the deposits. Traditional cleaning tools and methods, such as induction or canister tools, use only a simple valve to manually increase or decrease the rate of dispensing the cleaning solution and offer little ability to control and ensure that the proper amount of cleaning solution at an appropriate rate reaches the valves for an appropriate amount of exposure time. Therefore, the technician uses subjective analysis as to how much, how long, and at what rate the cleaning solution is injected.

SUMMARY OF THE INVENTION

The present invention relates to a method wherein a cable is coupled to an on-board diagnostic port on the vehicle, and a service hose with a misting nozzle adapter is coupled to a first port on a vehicle. The vehicle engine is then operated at a selected engine rpm, and a controller monitors data from the on-board diagnostic port on a vehicle. The data preferably includes the engine rpm, the catalytic convertor temperature, the engine coolant temperature, the mass air flow ("MAF"), and the manifold absolute pressure ("MAP"). The controller monitors information from the cleaning apparatus, and the information is processed to adjust the dispensing of the cleaning solution. The adjustment of the cleaning solution can vary the rate, volume, pressure, pulse interval, flow pattern, and duration of the solution in the engine. The controller dispenses the cleaning solution through the service hose to the first port on the vehicle, and the parameters of the flow are adjusted by the controller during the dispensing, in response to the information.

BRIEF DESCRIPTION OF THE DRAWINGS

FIG. 2 is an elevated, perspective view of a cleaning apparatus in accordance with the present invention;

FIG. 3 is an overhead view of the components for controlling the flow of cleaning solution;

FIG. 9 is an exemplary timing table for dispensing the cleaning solution for an induction service; and FIG. 10 is another exemplary timing table for dispensing the cleaning solution for an EGR service in accordance with the present invention.

DETAILED DESCRIPTION OF THE PREFERRED EMBODIMENTS

Figure 1:
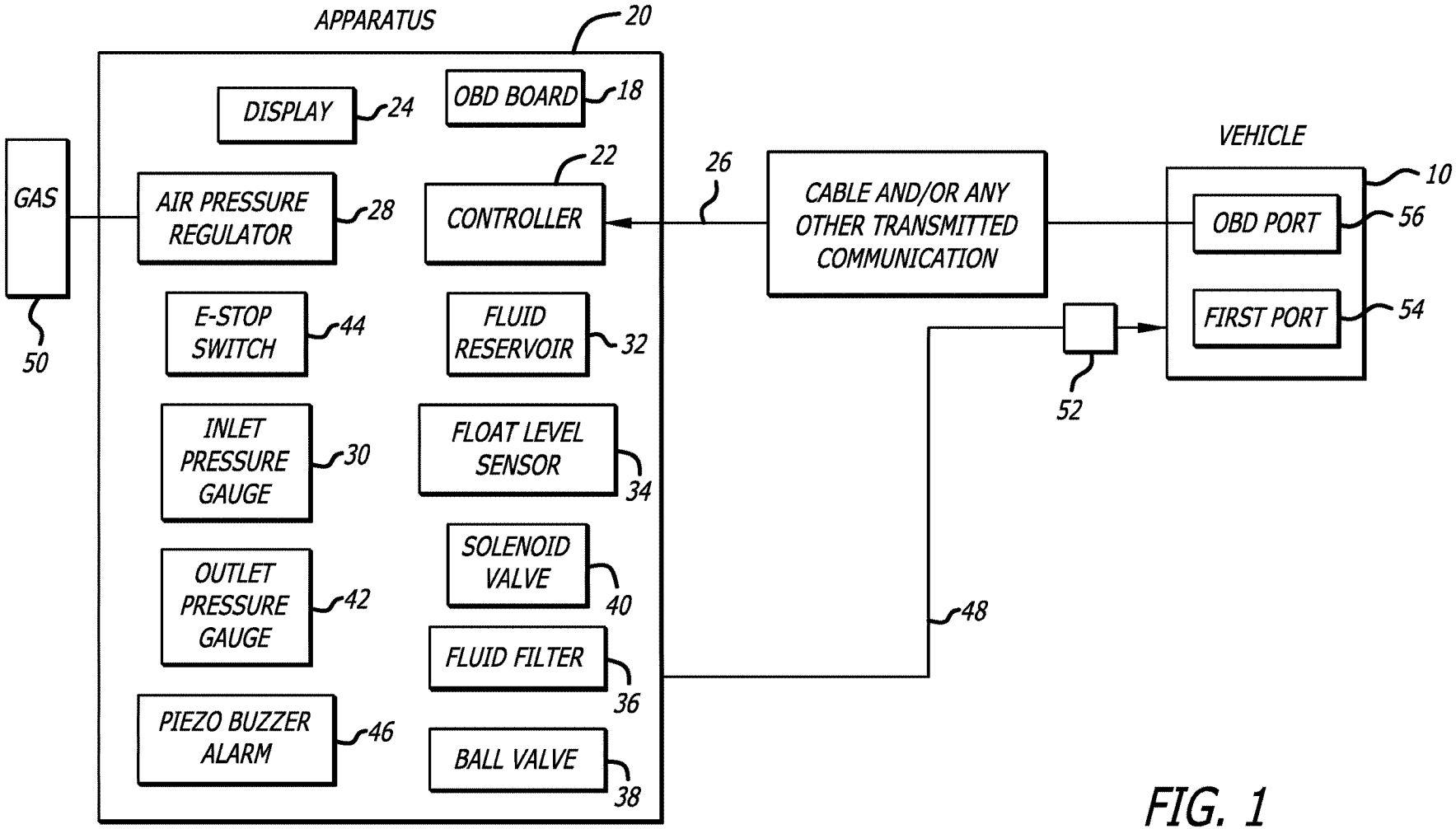
FIG. 1 is a schematic of a system for implementing the method of the present invention.

Reference now will be made in detail to embodiments of the disclosed invention, one or more examples of which are illustrated in the accompanying drawings. Each example is provided by way of explanation of the present technology, not as a limitation of the present technology. In fact, it will be apparent to those skilled in the art that modifications and variations can be made in the present technology without departing from the scope thereof. For instance, features illustrated or described as part of one embodiment may be used with another embodiment to yield a still further embodiment. Thus, it is intended that the present subject matter covers all such modifications and variations within the scope of the appended claims and their equivalents.

The method of the present invention for cleaning engine deposits disclosed herein includes attaching a data cable to an on-board diagnostic port on the vehicle to be serviced. The OBD port is typically used for diagnostics when the vehicle is not operating correctly or to facilitate emissions testing. A fluid service hose is connected to a first engine port on the vehicle, and the vehicle engine is operated at a predetermined engine rpm. A controller housed in a cleaning fluid supply machine monitors data from an on-board diagnostic port on a vehicle as the cleaning operation is commenced. The data includes, for example, an engine revolutions per minute (rpm), a catalytic convertor temperature, an engine coolant temperature, a mass air flow (MAF), and a manifold absolute pressure (MAP). The data received by the controller from the diagnostic port on the vehicle is used to control the delivery and conditions under which the cleaning operation proceeds, including rate of cleaning fluid delivery, volume of cleaning fluid, pressure of fluid delivery, interval of a pulse delivery, flow pattern, and/or duration of the cleaning fluid in the engine. The controller dispenses the cleaning solution through the fluid service hose to the first engine port on the vehicle, and the parameters of the fluid delivery is adjusted based on analysis by the controller.

The vehicle's on-board diagnostics (OBD) port transmits engine data during the cleaning in order to optimize the cleaning operation performance of the cleaning solution being injected into the system. The cleaning process may be customized by monitoring, adjusting and changing one or more of the flow parameters based on the severity of the deposit, engine size and engine feedback. Therefore, the dispensing is varied during the cleaning process in response to the data being transmitted from the vehicle. In other embodiments, the cleaning apparatus may operate in multiple modes to service air induction systems, fuel injection systems and EGR (Exhaust Gas Recirculation) systems.

If the flow rate of the cleaning fluid is dispensed too slowly, it may not allow enough cleaning solution into the engine intake at a volume that is adequate for effective cleaning and it may also unnecessarily extend the time it takes to perform the service. Moreover, if the flow rate of the cleaning solution is dispensed too quickly, it may enable the cleaning solution into the engine intake and cause damage to the engine. The present invention insures that the proper amount and flow rate of the cleaning solution is introduced to efficiently clean the engine without flooding the engine with the cleaning solution.

In various embodiments, the method described herein may be used for port fuel injection ignition engine systems, direct injection ignition engine systems, or diesel systems. The method is configured to be customized for the dispensing characteristics such as the volume of cleaning solution, pressure of dispensing, specific atomization patterns and spray timing/intervals. This ensures adequate exposure time of the cleaning solution on the deposits and effective removal. For example, some engines may require a higher pressure of dispensing the cleaning solution and a longer amount of time for the entire process based on the severity of the deposit buildup.

The present invention includes the feature whereby the fluid delivery machine includes the ability to read diagnostic trouble codes (DTC's) of the vehicle along with engine data via the same cable. This feature allows the user to read the trouble codes without having to connect a second device to the OBDII port. The present invention achieves this objective with a modified new controller board and software.

In addition to reading the diagnostic trouble codes (DTC's) via the OBDII cable, the present invention includes the ability to clear the diagnostic trouble codes. Trouble codes can appear when the hoses and sensors are disconnected to provide access to the adapters during a service. If a trouble code does appear during the service, the user can use the present invention, which is already connected to the OBDII port, to clear the codes.

While the present invention can be used with a Programmable Logic Controller (PLC), as a PLC allows use of a standard universal controller board and LCD display. The present invention included new custom firmware to operate with a universal controller board, which is displayed on a 4" LCD screen. During the testing of this machine in the EGR service, it was discovered that it is necessary to control the EGR valve to be opened and to remain open during the service so the cleaning fluid travels to the correct areas. Accordingly, the present invention preferably includes a new EGR actuator cable & adapters to connect to the different EGR valve electrical connectors that remotely manipulates the valve open. The signal sent to the controller is sent as a pulsing signal to prevent damaging the EGR valve.

Turning to the Figures, FIG. 1 is a schematic of a vehicle 10 and fluid delivery machine 20 system that utilizes the method of the present invention. The cleaning apparatus 20 includes several components such as a controller 22, controller display 24, cable 26, air pressure regulator 28, inlet pressure gauge 30, fluid reservoir 32, float level sensor 34, fluid filter 36, ball valve 38, solenoid valve 40, outlet pressure gauge 42, emergency stop switch 44, piezo buzzer 46, and service hose 48 with misting nozzle adapter.

In one embodiment, the controller 22 may be a configured to regulate the on/off function of the cleaning apparatus 20. Information associated with the dispensing of the cleaning solution such as rate, volume, pressure, flow rate, pulse interval, flow pattern and residency time may be programmed and controlled. In some embodiments, there may be a plurality of controllers. For example, one controller may control the functions of the cleaning apparatus while a second controller may convert the OBD language or codes to standard controller chips.

An external gas supply 50, such as from a pressurized tank or other source, supplies gas to the apparatus 20 to pressurize the system, which in turn can be used to deliver the fluid. The gas pressure regulator 28 reduces the pressure of the inlet external gas while the inlet pressure gauge 30 monitors the gas pressure from the air pressure regulator 28. The fluid reservoir 32 may be a refillable pressurized canister with an integrated pressure release value in the lid that stores the cleaning solution. The float level sensor 34 monitors the system during the cleaning operation and indicates when the procedure is complete. The fluid filter 36 filters the cleaning solution as necessary. The ball valve 38 and the emergency stop switch 44 function as a mechanical override that, when activated, stops the flow of the cleaning solution from the apparatus 20. The solenoid valve 40 controls the flow of the cleaning solution and has pulsing abilities to customize the cleaning process based on the characteristics and conditions. The outlet pressure gauge 42 monitors the outlet pressure. The piezo buzzer alarm 46 provides an audio alert to the user for warnings or indicators that the procedure is complete. For example, when the cleaning solution in the fluid reservoir 32 has been consumed, the system returns to a startup mode and the piezo buzzer alarm 46 indicates that the service is complete by an audio alert. The service hose 48 with induction misting nozzle adapter 52 dispenses the cleaning solution at the inlet port 54 of the vehicle 10. The cable 26 is connected to the existing OBD port 56 of the vehicle 10 to monitor and transmit vehicle data, or the connection can be made by some other means such as wireless, bluetooth, etc.

FIG. 2 and FIG. 3 depict an exemplary embodiment of the apparatus 20 used to carry out the method of the present invention, with the cover down and up, respectively. The various components described in the previous paragraphs are illustrated in relation to the other components in FIGS. 2 and 3.

Figure 4:
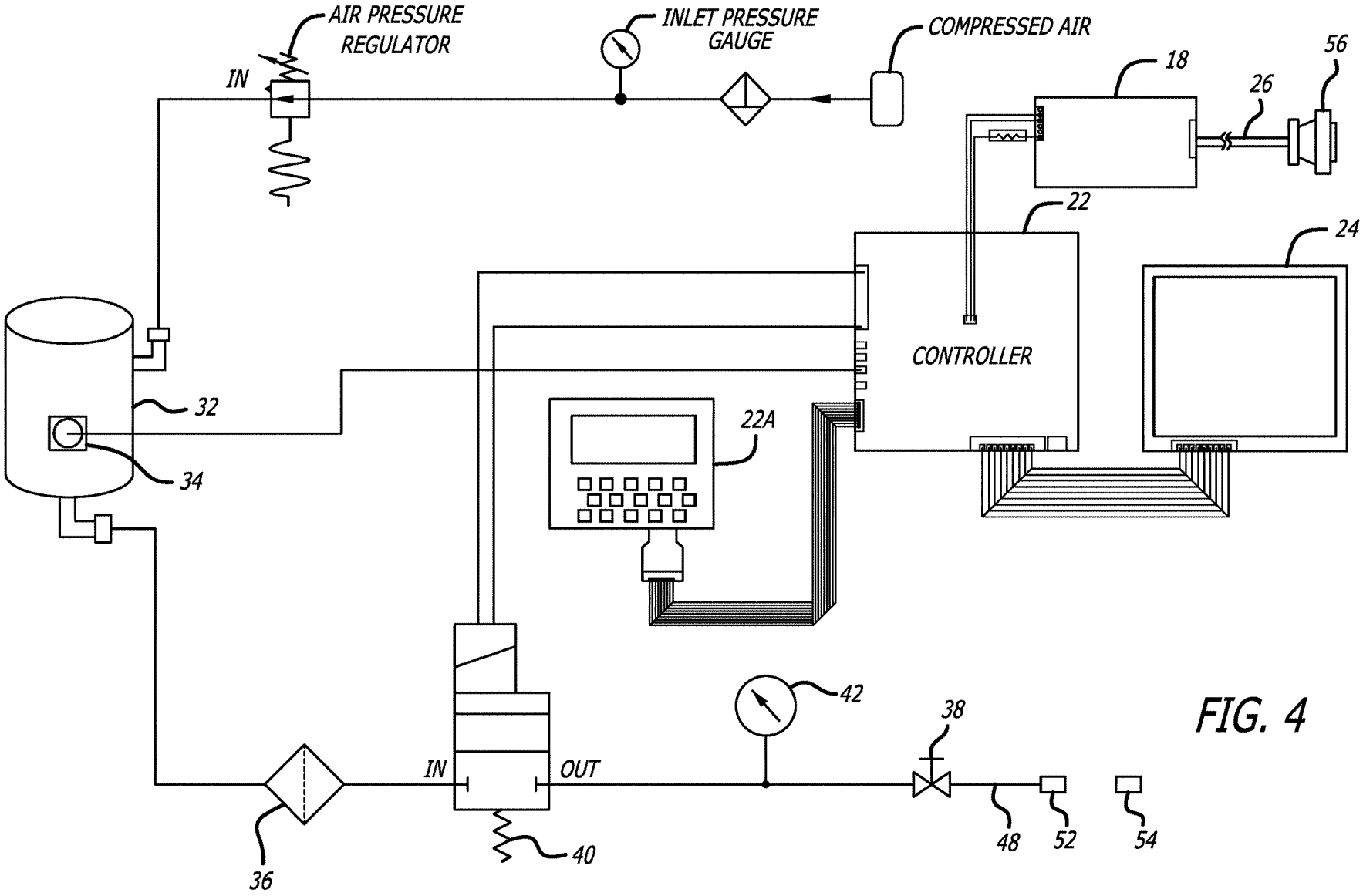
FIG. 4 is schematic of a hydraulic system used in the method of the present invention.

FIG. 4 is a schematic of the hydraulic system of apparatus 20. Typically, the vehicle 10 has an onboard computer management system, such as an electronic control module (ECM), that communicates with, monitors and may control the various systems of a vehicles as "nodes" on a controller area network, also known as a CAN bus system. In the present invention, preferably any system or protocol may be used that allows communication between controllers and devices. For example, data from various systems of the vehicle 10 such as engine rpms, catalytic converter temperature, engine coolant temperature, MAF, MAP or the like, are communicated to the onboard computer management system. This data is then accessed by the apparatus 20 via the cable 26 connected to the OBD port 56. The information is received by the OBD board 18 and then interpreted for use by the controller 22. The controller 22 includes its own controller display 22*a*, with an input keyboard for entering information. By monitoring one or a combination of the vehicle's system parameters using the OBD board, which may include a reader, scanner device or the like, these may be adjusted before, during or after the cleaning process. By monitoring and learning these parameters during the cleaning process, the user has the ability to customize the flow rate during the cleaning process based on these conditions. This in turn provides a more effective and efficient cleaning procedure.

Figure 5:
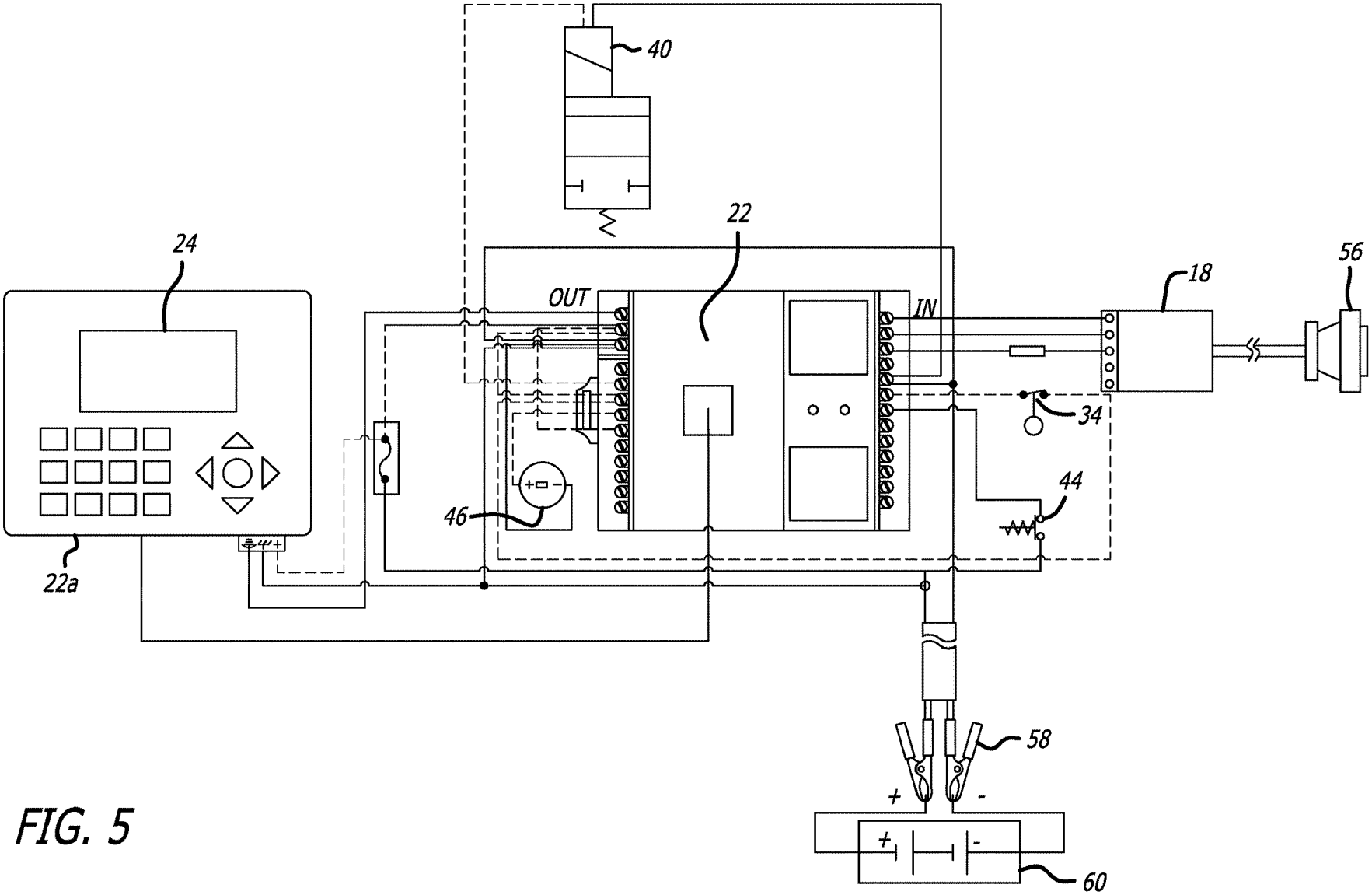
FIG. 5 is a schematic of an electrical system used in the method of the present invention.

The controller display 24, screen or monitor is preferably a graphical user interface and may be integrated or coupled to the cleaning apparatus 20 that presents data and information to a user, such as a technician, before, during and after the cleaning process. The data and the information are displayed on the display 24 of the cleaning apparatus. In some embodiments, the service hose 48, cable 26, controller 22, and cleaning solution are integrated in or coupled to the cleaning apparatus 20. In a preferred embodiment, the cleaning apparatus 20 may be powered by an external power source. FIG. 5 illustrates an electrical schematic where the cleaning apparatus 20 is powered by the battery 60 of the vehicle 10 via jumper cables 58.

Figure 6:
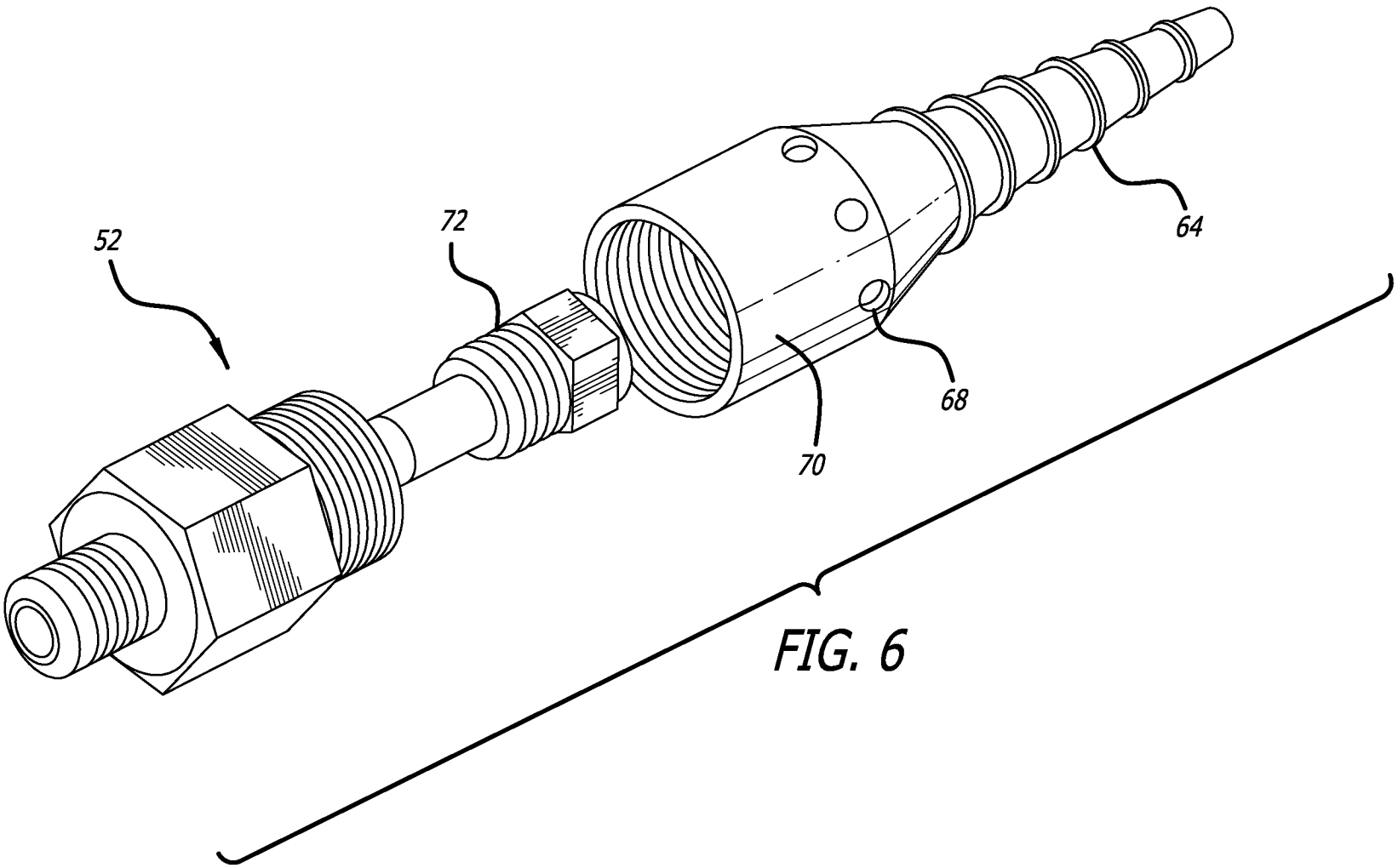
FIG. 6 is an exploded, perspective view of the misting nozzle adapter of the service hose of the cleaning apparatus.

FIG. 6 illustrates a misting nozzle adapter 52 disposed at the end of the service hose 48 of the cleaning apparatus 20. The adapter 52 has graduated ridges or barbs 64 that allow a secure fit to multiple hoses, and vents 68 are arranged circumferentially around a base 70 to allow ambient air to enter the spray chamber for atomizing the fluid prior to injection into the vehicle 10. A spray nozzle 72 with a pre-installed screen that filters any contaminants delivers the fluid to the spray chamber. In further embodiments, other nozzles and/or adapters may be used depending on the vehicle, type of cleaning process such as fuel injection or EGR services, severity of the condition or the like.

Figure 7A:
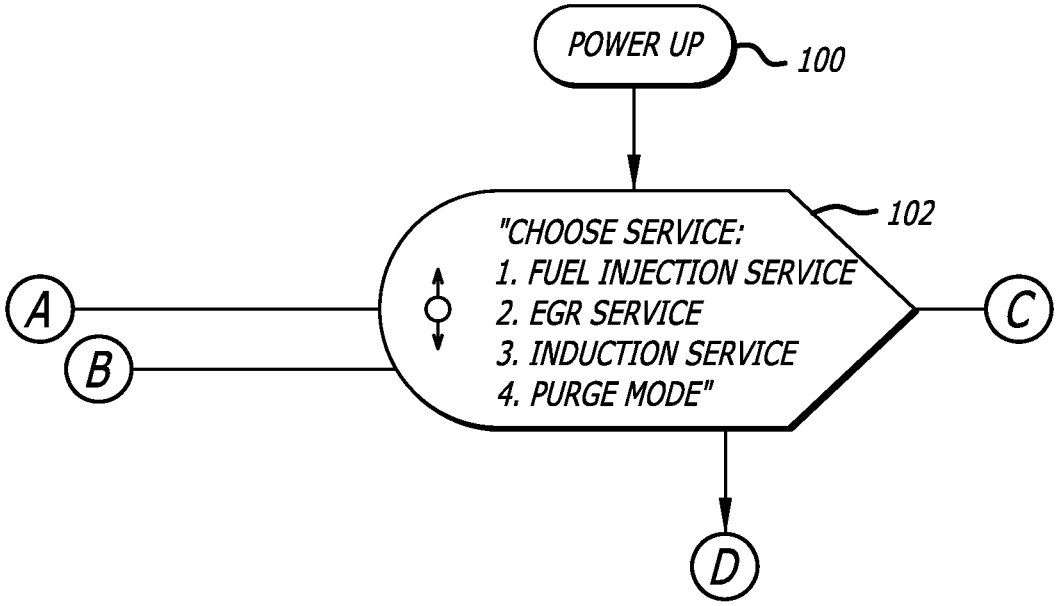
FIGS. 7A-7E are flowcharts pertaining to the operation of the apparatus for carrying out the present invention.
Figure 7B:
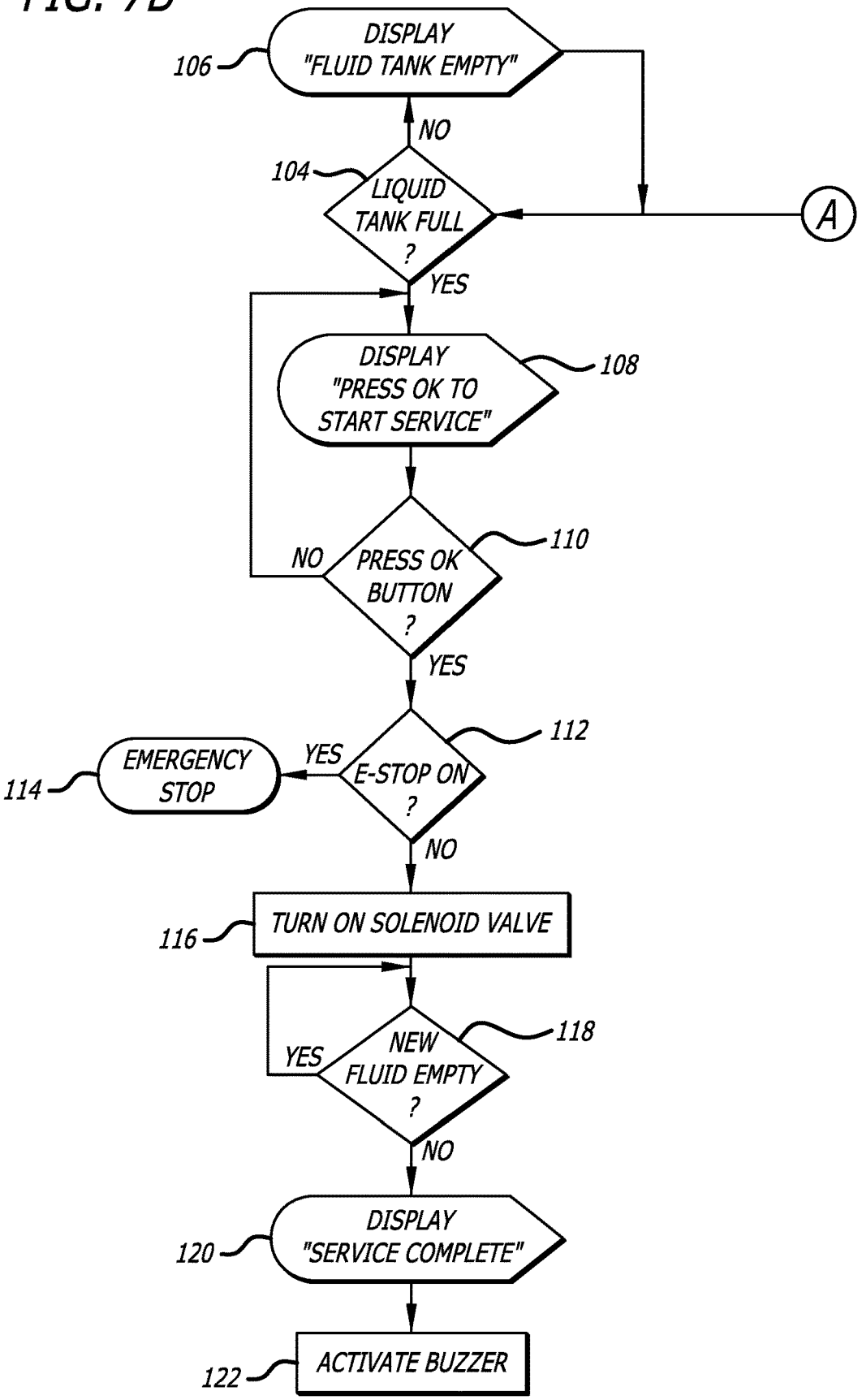

FIGS. 7A-7E are flowcharts of the operation of the apparatus 20 for cleaning engine deposits in accordance with the present invention. FIG. 7A is a start-up program that begins with a power up step 100 followed by a menu display in step 102 where the user selects the type of service to be performed. The paths A, B, C, and D from which the program diverts correspond to FIGS. 7B, 7E, 7D, and 7C, respectively. FIG. 7B is the first option, directed to a fuel injection routine. The first step 104 determines whether the fluid reservoir 32 is filled with fluid. If not, step 106 displays a "Fluid Empty" message and returns to the beginning step. The next step 108 displays a message to proceed with initiation of the cleaning operation, and step 110 invites the user to actuate the process. The apparatus 20 checks in step 112 to make sure the e-stop switch 44 is not engaged in step 114, and then turns on the solenoid valve 40 in step 116. Step 118 continues to monitor the level of fluid in the reservoir 32, until the operation is complete and a message indicating completion in step 120 is displayed. An audible alert is sounded in step 122 to notify the user of the end of the procedure.

Figure 7C:
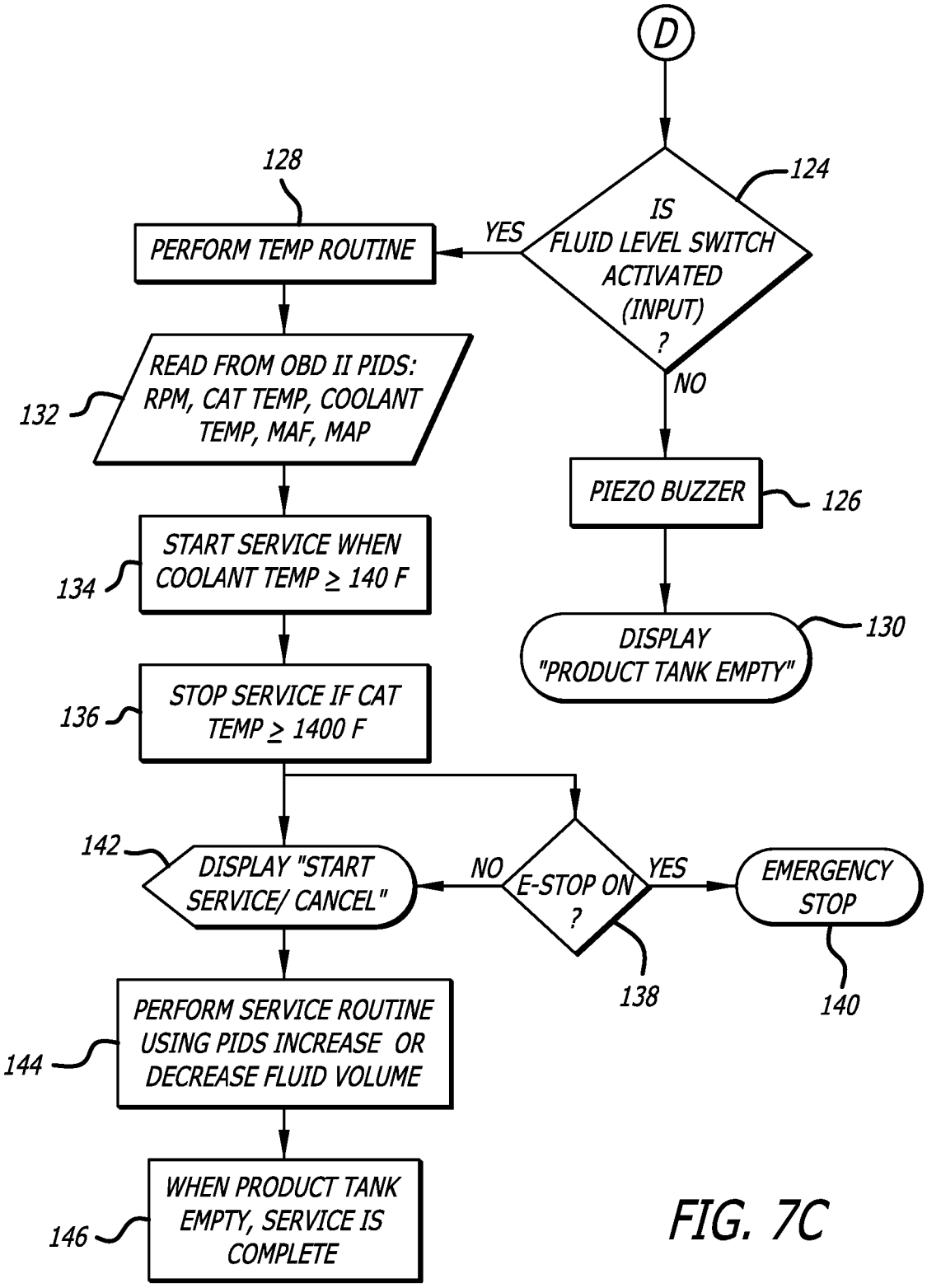

FIG. 7C illustrates the EGR procedure, beginning at step 124 which checks the fluid level switch and sounds an alert in step 126 if the switch is not activated and displaying an error message in step 130. If the level switch is activated, the controller initiates a temperature evaluation in step 128. In step 132 the onboard vehicle data is polled for RPM, catalytic converter ("CAT") temperature, coolant temperature, mass air flow rate, and MAP. When the coolant temperature reaches 140°, the service initiates in step 134 and stops in step 136 when the CAT temperature exceeds 1400°. If it is determined in step 138 that the emergency stop switch is not engaged, the service continues in step 142, else stops in step 140. The apparatus 20 performs the service in step 144, and terminates in step 146 when the reservoir is empty in step 146.

Figure 7D:
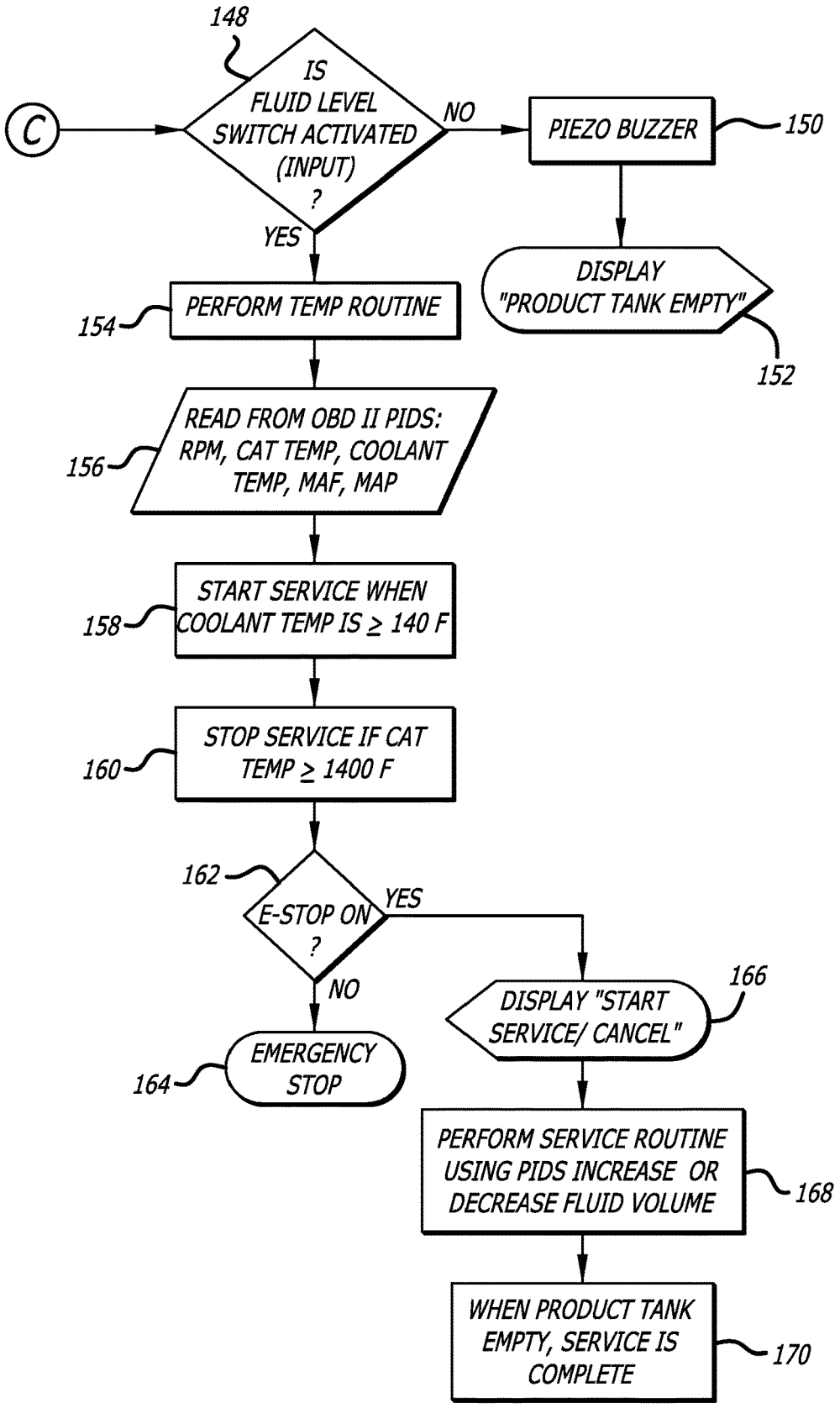

In FIG. 7D, the induction service is illustrated beginning in step 148 where the fluid level switch is checked, and actuating the buzzer and error message in steps 150 and 152 respectively if the reservoir is empty. If there is fluid in the reservoir, the temperature routine is initiated in step 154 and in step 156 the onboard vehicle data is polled for RPM, CAT temperature, coolant temperature, mass air flow rate, and MAP. When the coolant temperature reaches 140°, the service initiates in step 158 and stops in step 160 when the CAT temperature exceeds 1400°. If it is determined in step 162 that the emergency stop switch is not engaged, the service continues in step 166, else stops in step 164. The apparatus 20 performs the service in step 168, and terminates in step 170 when the reservoir is empty in step 146.

Figure 7E:
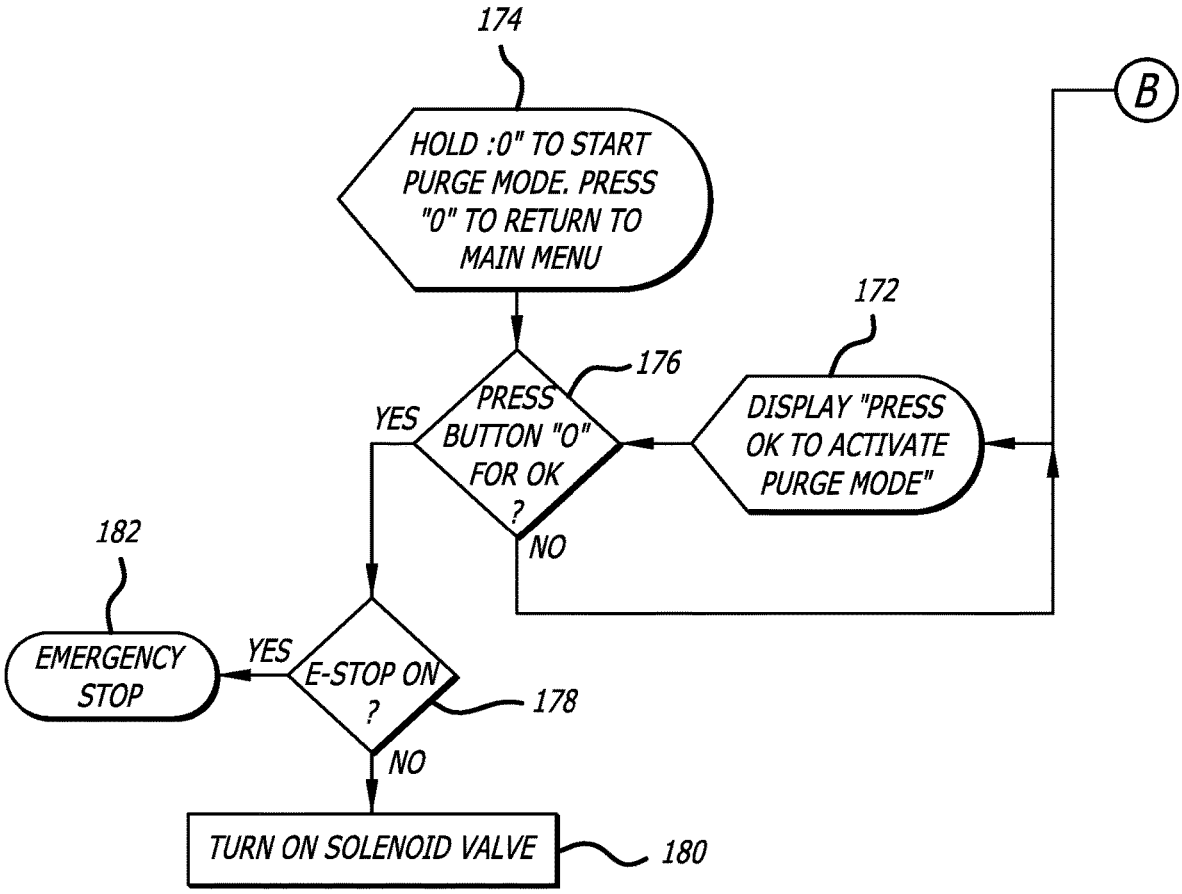

The final procedure on the menu corresponds to the purge operation shown in FIG. 7E. A message in step 172 invites the user to begin the purge operation, and another message with instructions to begin the purge is displayed in step 174. Step 176 returns the operation to the main menu if the purge is not initiated, or checks the status of the emergency stop in step 178 if the purge is initiated. The routine stops the purge in step 182 if the emergency switch is actuated, otherwise the solenoid is turned on in step 180 to begin the purge operation. The purge mode clears the service hose of cleaning solution prior to performing one of the preceding services such as an induction cleaning (FIG. 7D), a fuel injection cleaning (FIG. 7B), or an EGR cleaning (FIG. 7C).

TABLE 1

| | INPUTS | OUTPUTS |
|---|---|---|
| 1 | CONTROLLER | CONTROLLER DISPLAY |
| 2 | FLOAT LEVEL SENSOR | SOLENOID VAVLE |
| 3 | OBD II #1 RPM | PIEZO BUZZER |
| 4 | OBD II #2 B1S1 CAT TEMP | |
| 5 | OBD II #3 ECT - ENGINE COOLANT TEMP | |
| 6 | OBD II #4 MAF | |
| 7 | OBD II #5 MAP | |
| 8 | DTC SET - Diagnostic Trouble Code | |
| 9 | Clear DTCs before and after service | |

The table 1 shows the various inputs to the controller 22 and the outputs from the controller 22. Inputs include the level sensor 34, the engine parameters (rpm, catalytic converter temp, engine coolant temp, MAF, and MAP), and the diagnostic error codes. The outputs are the display 24, the solenoid valve 40, and the piezo buzzer 46.

Figure 8:
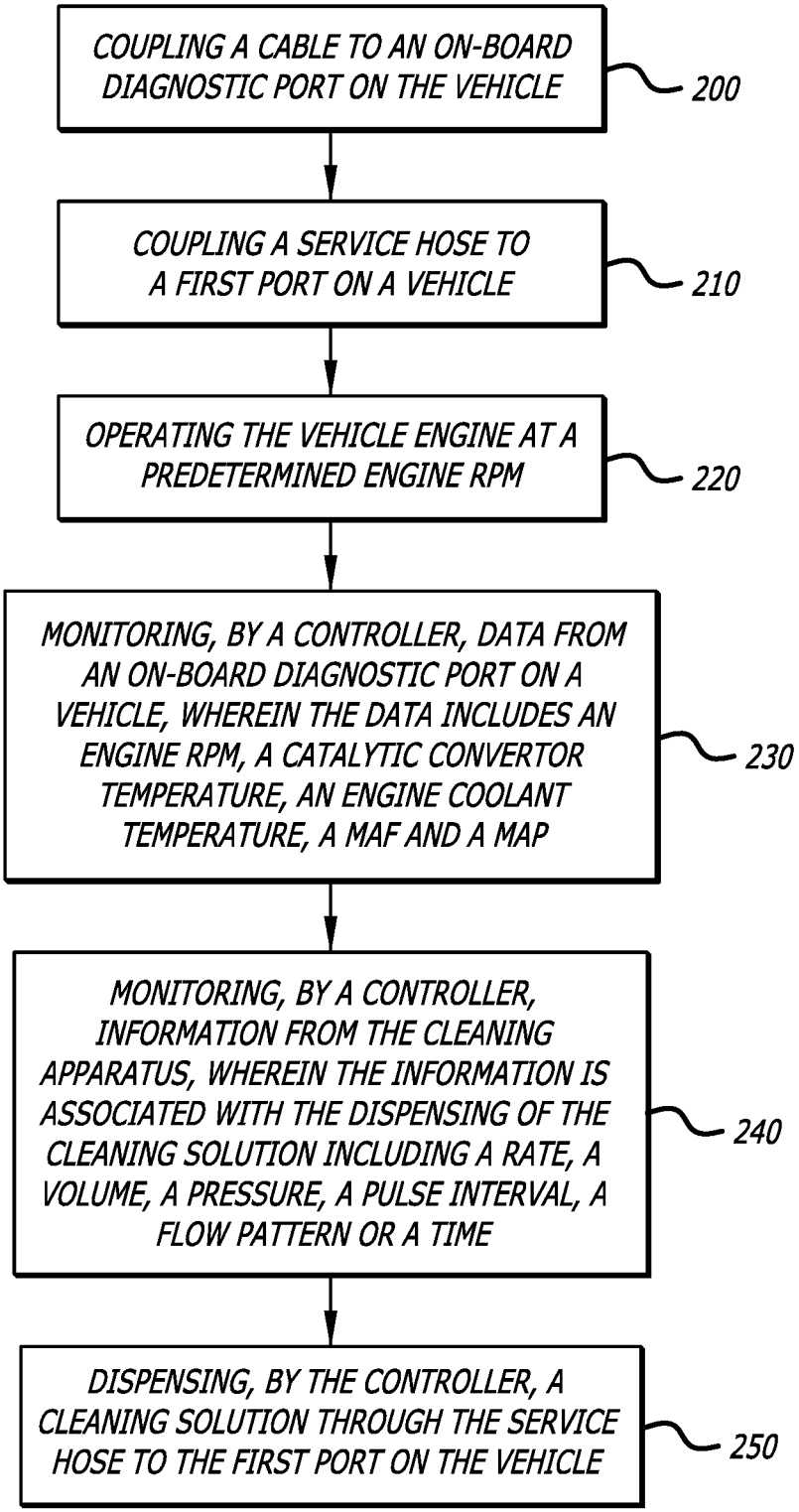
FIG. 8 is a flowchart pertaining to the method of the present invention.

FIG. 8 is a flowchart of the method for cleaning engine deposits in accordance with the present invention. The method starts at step 200 by coupling a cable 26 to an on-board diagnostic port 56 on a vehicle 10. Then, at step 210 a service hose 48 is coupled to a first port 54 on the vehicle 10. At step 220, the engine of the vehicle is operated at a predetermined engine rpm. In some embodiments, the predetermined engine rpm is 1000 rpm to 1800 rpm. At step 230, a controller 22 monitors data from an on-board diagnostic port 56 on the vehicle 10. The data includes an engine rpm, a catalytic convertor temperature, an engine coolant temperature, a MAF and a MAP. At step 240, the controller 22 receives information from the cleaning apparatus 20. The information is associated with the dispensing of the cleaning solution including one or more of a rate, a volume, a pressure, a pulse interval, a flow pattern or a time. A monitor 24 displays the data and information to the user. At step 250, the controller 22 dispenses a cleaning solution through the service hose to the first port 54 on the vehicle 10. The cleaning fluid is delivered during the operation and adjusted in response to the data. By using data of the operating conditions of the vehicle during service, the information from the cleaning apparatus 20 may be adjusted or changed such as varying the characteristics of the dispensing thus preventing or significantly reducing damage or a catastrophic failure of the engine before, during and after the cleaning process.

For example, the user or technician couples the cable 26 to an existing OBD port 56 on the vehicle 10. OBD systems give the user or technician access to the status of the various vehicle subsystems. Typically, OBD implementations use a standardized digital communications port to provide real-time data in addition to a standardized series of diagnostic trouble codes (DTCs) which allow one to rapidly identify and consequently remedy malfunctions within the vehicle. In other embodiments, the OBD data may be communicated via Bluetooth® technology or the like.

Next, the technician couples a service hose 48 from a cleaning apparatus 20 to a first port 54 on a vehicle. The service hose 48 includes an induction misting nozzle adapter 52 and is attached to a first port 54 on the vehicle which may be a vacuum source produced by the engine between the air filtration device and combustion chamber such as the intake manifold, the vacuum line that feeds the brake booster, or the like. The technician, in one embodiment, attaches the cleaning apparatus 20 to a compressed air source 50. This may be any type of compressed gas and is used to pressurize the cleaning solution in the fluid reservoir 32 of the cleaning apparatus and aid in the delivery of the cleaning solution to the vehicle 10. In another embodiment, a pump (not shown) may be used to transmit the cleaning solution to the vehicle. The pressure regulator 28 limits the pressure during the cleaning operation to the desired value. Depending on what type of service is being performed, the appropriate adapter may be installed on the service hose 48 to introduce the cleaning solution into the system, such as the fuel system. The vehicle is then started and run at a predetermined engine rpm. In some embodiments, the predetermine engine rpm is at least 1000 rpm to 1800 rpm.

The cleaning solution is dispensed by the controller 22 of the cleaning apparatus 20 during the cleaning service or process while the vehicle is operating at a predetermined rpm. In one embodiment, the flow rate or dispensing rate of the cleaning solution is dependent on the pressure and time that the solenoid valve 40 is energized which allows the cleaning solution to enter the system of the vehicle at a known rate and interval. The dispensing rate can be manipulated by varying the pressure of the gas or the amount of time the solenoid valve 40 is opened and closed. The time or length of the cleaning process is dependent on the information associated with the dispensing of the cleaning solution such as rate, volume, pressure, dispensing or flow rate, pulse interval or flow pattern. Moreover, the length of time varies from vehicle to vehicle based on other factors such as type of engine system, size of the engine, severity of the condition, feedback or the like. The cleaning process may be customized by adjusting the volume of the cleaning solution, pressure of the cleaning solution, dispensing or flow rate of the cleaning solution, and length of the cleaning process. In some embodiments, data from the OBD port 56 and information from the vehicle 10 are monitored and displayed to the technician during the cleaning process. This may be displayed on the cleaning apparatus, a scanner device or a combination thereof.

Information from the cleaning apparatus is monitored and controlled by the controller 22. The information is associated with the dispensing of the cleaning solution such as rate, volume, pressure, dispensing or flow rate, pulse interval, flow pattern and time. Data is monitored by the controller 22 of the cleaning apparatus 20 from the OBD port 56 on a vehicle. In one embodiment, this is accomplished via a cable 26 coupled to the existing OBD port 56 of the vehicle. The OBD port may be used for diagnostics alerting the technician to MIL/DTC (Malfunctioning Indication Lamp/Diagnostic Trouble Code) status. If either MIL or DTCs are detected prior to the cleaning service, a warning screen may be displayed requesting the issues be resolved before continuing with the cleaning service. In some embodiments, there may be an option to override this lock out feature.

The data includes the operating conditions of the vehicle such as engine rpm, the catalytic convertor temperature, the engine coolant temperature, MAF and MAP. In this way, the data and information are monitored to ensure the vehicle does not stall or that hydrostatic lock of the engine does not occur during or after the cleaning process. Hydrostatic lock of the engine is a condition when the volume of liquid is greater than the volume of the cylinder at its minimum, or at the end of the piston's stroke, and enters the cylinder. Since liquids are nearly incompressible the piston cannot complete its travel and thus causes catastrophic engine damage.

The dispensing of the cleaning solution is accomplished by controlled metering and in one embodiment, a pulse interval or an on/off pattern of flow of the cleaning solution therefore having an adjustable or varying dispensing interval. In various embodiments, this may be a repeating pattern of dispensing the cleaning solution for less than 5 seconds then not dispensing for less than 20 seconds, or 5 seconds of dispensing and 15 seconds of no dispensing, or 10 seconds of dispensing and 10 seconds of no dispensing, or 15 seconds of dispensing and 10 seconds of no dispensing, or 25 seconds of dispensing and 10 seconds of no dispensing, or 9 to 11 seconds of dispensing and 4 to 6 seconds of no dispensing, or dispensing and 0 seconds of no dispensing. FIG. 9 is an example of a timing table for dispensing the cleaning solution in accordance with some embodiments. A pulse interval ratio of dispensing to no dispensing may be 1:4, 1:3, 1:1, 3:2, 5:2 or 1:0. FIG. 10 is an example of a timing table for dispensing the cleaning solution for an EGR service in accordance with some embodiments.

The method ensures a prolonged and more complete exposure to the cleaning solution. The pulse interval of dispensing can be varied such as by increments to maximize the amount of cleaning solution injected for cleaning while avoiding too quickly of a dispensing rate that may lead to hydrostatic lock of the engine. Moreover, by pulsing the cleaning solution causing variable on/off time, the engine of the vehicle is given time to process and/or combust the cleaning solution before more is introduced risking pooling or flooding. By monitoring the data such as the catalytic converter temperature, a dispensing rate pattern or pulse interval may be established and maintained that does not tax the catalytic converter by raising its temperature to an unsafe level that causes damage.

The cleaning solution may be dispensed when the vehicle is at particular operating conditions in particular ranges. For example, more effective cleaning and deposit removal may be achieved when the vehicle is at a particular operating temperature. By monitoring engine coolant temperature, in some embodiments, the controller can start the cleaning process or the dispensing of the cleaning solution when the engine coolant temperature is at a particular value such as 140 degrees F. Additionally, if the engine rpm decreases to a certain value or the vehicle stalls, the controller of the cleaning apparatus ceases the dispensing of the cleaning solution. [045] A potential side effect of traditional cleaning processes through the air intake or the fuel rail injectors is the combination of the fuel and the cleaning solution which puts too much strain on the catalytic converter, causing it to exceed recommended operating temperatures. This may damage the oxygen sensor (O2 sensor) or the catalytic converter. Other cleaning methods available for cleaning engine deposits may estimate the proper flow rate of the cleaning solution and periodically check the catalytic converter temperature with an external thermometer or sensor which is time consuming and possibly inaccurate. The method disclosed herein is configured to monitor the catalytic converter temperature and adjust the flow rate of the cleaning solution to ensure the temperature of the catalytic converter maintains an acceptable range.

In one embodiment, the cleaning solution is dispensed when the engine rpm is at least 1000 rpm to 1800 rpm and the catalytic convertor temperature is less than 1400 degrees F. Depending on the data, the information associated with the dispensing of the cleaning solution including one or more of a rate, a volume, a pressure, a pulse interval, a flow pattern or a time may be adjusted or varied when the data is outside of the particular ranges to ensure damage is not caused to the vehicle. In one scenario, the dispensing rate is decreased when the catalytic convertor temperature reaches a threshold such as greater than 1400 degrees F. and may be completely stopped when the catalytic convertor temperature is 1600 degrees F. In another scenario, the dispensing rate is decreased when the engine rpms are under a threshold such as less than 30%-60% of the predetermined engine rpm or stopped completely when the engine rpms are under a threshold such as less than 60%-80% of the predetermined engine rpm. In some embodiments, the predetermined engine rpm is 1000 rpm to 1800 rpm. The dispensing rate of the cleaning solution may be regulated for a combination of factors based on the data. For example, MAF can be used to in conjunction with engine rpm data to fine tune the amount of cleaning solution dispensed.

In the present invention, information associated with the dispensing of the cleaning solution includes one or more of rate, volume, pressure, pulse interval, flow pattern or time from the cleaning apparatus and the data such as engine rpm, the catalytic convertor temperature, the engine coolant temperature, the MAF and the MAP from the vehicle are monitored and adjusted during the cleaning process. Based on the data and information, the controller of the cleaning apparatus automatically adjusts or varies the characteristics of the dispensing of the cleaning solution such as one or more of rate, volume, pressure, pulse interval, flow pattern or time. By controlling the characteristics of the dispensing, instead of only having on/off capabilities as in typical systems and methods, the cleaning process is efficient, safe and effective removing the guess work by the technician, who may be skilled or unskilled, for an choosing the appropriate dispensing characteristics.

Another object of the present invention is to produce a cost effective, smaller unit with the same capabilities that can be used with an auxiliary pressurized fluid tank. Some service stations have a current pressurized fluid canister. To reduce the cost to our customers, the present invention omits elements of traditional units, such as the chassis, wheels, and 64 oz canister. This new module is designed to work with an existing and prevalent pressurized fluid canisters, but can also work with any pressurized fluid canister if the right connection fittings are added. Using an auxiliary tank, there is no fluid level sensor or buzzer to provide an audio alert when the service is complete. The fluid level must be monitored throughout the service, and the service will be ended by choosing "SERVICE COMPLETE" on the control panel when the cleaning solution has been consumed.

While the specification has been described in detail with respect to specific embodiments of the invention, it will be appreciated that those skilled in the art, upon attaining an understanding of the foregoing, may readily conceive of alterations to, variations of, and equivalents to these embodiments. These and other modifications and variations to the present invention may be practiced by those of ordinary skill in the art, without departing from the scope of the present invention. Furthermore, those of ordinary skill in the art will appreciate that the foregoing description is by way of example only, and is not intended to limit the invention. Thus, it is intended that the present subject matter covers such modifications and variations.

We claim:

1. A method for removing deposits on a vehicle's combustion engine, comprising:

(1) providing a fluid delivery machine in proximity with a vehicle to be serviced;

(2) providing a pressurized gas source to the fluid delivery machine;

(3) connecting the fluid delivery machine to an OBD port of the vehicle;

(4) connecting the fluid delivery machine to a first inlet port of the combustion engine via a service hose;

(5) combusting fuel in the combustion engine and providing a flow of cleaning fluid to the first inlet port using the pressurized gas source;

(6) analyzing preselected engine characteristics from the OBD port selected from a group comprising engine revolutions per minute (rpm), catalytic convertor temperature, engine coolant temperature, mass air flow (MAF), and manifold absolute pressure (MAP), and adjusting the flow of cleaning fluid from the fluid delivery machine to the first inlet port based upon at least one of said preselected engine characteristics;

(7) displaying a status on a display of the fluid delivery machine; and (8) disconnecting the fluid delivery machine from the first inlet port and connecting the fluid delivery machine to a second inlet port, and repeating steps (5) through (7).

2. The method for removing deposits of claim 1, wherein the adjusting the flow comprises pulsing the flow.

3. The method for removing deposits of claim 1, wherein the adjusting the flow comprises increasing a flow rate of the flow.

4. The method for removing deposits of claim 1, wherein the adjusting the flow comprises increasing a pressure supplied by the pressurized gas source.

5. The method for removing deposits of claim 1, wherein the adjusting the flow comprises changing a spray timing interval.

6. The method for removing deposits of claim 1, further comprising monitoring the flow to prevent flooding the combustion engine with cleaning fluid.

7. The method for removing deposits of claim 1, wherein the adjusting the flow comprises adjusting a spray pattern using a misting nozzle.

8. The method for removing deposits of claim 1, further comprising clearing error codes received from the OBD port.

9. The method for removing deposits of claim 1, further comprising providing a solenoid valve in the fluid delivery machine to control the flow of cleaning fluid based on the analyzing preselected engine characteristics.

10. The method for removing deposits of claim 1, wherein the flow is controlled to prevent hydrostatic lock by ensuring a volume of cleaning fluid in an engine cylinder is not greater than a volume at an end of the cylinder's stroke.

* * * * *